US005242258A

United States Patent [19]

Weyer

[11] Patent Number: 5,242,258

[45] Date of Patent: * Sep. 7, 1993

[54] QUICK DISCONNECT BUCKET ACTUATOR

[76] Inventor: Paul P. Weyer, P.O. Box 398, Enumclaw, Wash. 98022

[ * ] Notice: The portion of the term of this patent subsequent to Sep. 8, 2009 has been disclaimed.

[21] Appl. No.: 899,921

[22] Filed: Jun. 17, 1992

Related U.S. Application Data

[63] Continuation-in-part of Ser. No. 722,865, Jun. 28, 1991, Pat. No. 5,145,313.

[51] Int. Cl.[5] ..... E02F 3/36

[52] U.S. Cl. ..... 414/723; 403/15

[58] Field of Search ..... 414/723, 705; 37/103, 37/118 R, 118 A; 403/15, 36, 38

[56] References Cited

U.S. PATENT DOCUMENTS

| | | | |
|---|---|---|---|
| 4,042,131 | 8/1977 | Buttke . | |
| 4,277,899 | 7/1981 | Güthoff | 37/103 |
| 4,307,991 | 12/1981 | Bridwell et al. | 414/687 |
| 4,639,183 | 1/1987 | Güthoff | 414/705 |
| 4,906,161 | 3/1990 | Weyer | 414/705 |
| 4,944,628 | 7/1990 | Huldén | 403/24 |
| 5,145,313 | 9/1992 | Weyer | 414/723 |

OTHER PUBLICATIONS

Raine, "Tilt Bucket", B1192-8 (Feb. 1988).

Wain-Roy Inc., "The Wain-Roy ®Rota-Jaw Bucket", WR-002 CP-10M-Feb. 1985.

*Primary Examiner*—Frank E. Werner

*Assistant Examiner*—Donald W. Underwood

*Attorney, Agent, or Firm*—Seed and Berry

[57] ABSTRACT

A fluid-powered, laterally tiltable quick disconnect bucket actuator. An actuator has a generally cylindrical body with an output shaft rotatably disposed therein with an axis in general parallel alignment with a forward rotation plane through which the bucket is rotatable on a backhoe arm by the operation of a rotation link. A bracket is attached to the body and has a pair of clevises for pivotal attachment to the vehicle arm and rotation link. In one embodiment, the shaft has two pair of attachment forks for attaching the shaft to corresponding clevises of a bucket. One pair of the forks is attached to and moves axially with a member which is selectively extendable relative to the shaft to move the pair of forks between a locking position holding the bucket and a release position allowing disconnection of the bucket. A linear-to-rotary transmission device disposed within the body produces rotational movement of the shaft relative to the body to produce lateral tilting of the bucket in a lateral plane generally transverse to the forward rotational plane for the bucket. In alternative embodiments, the extendable member has a locking pin portion which is extended to seat in a bucket receiver aperture to lock the bucket in position or retracted within a shaft aperture to release the bucket. In one alternative embodiment, the extendable member is manually rotated to move it longitudinally between the locking and release positions, and in another alternative embodiment the extendable member is moved by a hydraulic piston.

24 Claims, 11 Drawing Sheets

QUICK DISCONNECT BUCKET ACTUATOR

CROSS-REFERENCE TO RELATED APPLICATION

This application is a continuation-in-part of U.S. application Ser. No. 07/722,865 filed Jun. 28, 1991, now issued as U.S. Pat. No. 5,145,313.

TECHNICAL FIELD

The present invention relates generally to backhoes and excavators and, more particularly, to buckets and other tools which are laterally tiltable.

BACKGROUND OF THE INVENTION

Backhoes, excavators and similar type vehicles have an extendable or articulated arm with a tool such as a bucket attached at an end thereof remote from the operator. Generally, a rotation link is associated with the arm. The bucket is pivotally attached to the arm by a clevis which serves as a pivot point for the bucket. The rotation link is also pivotally attached to the bucket so that movement of the rotation link causes the bucket to rotate about the arm pivot point. With such an arrangement, the bucket can be rotated relative to the arm in a generally vertical, forwardly extending plane defined by the arm and the rotation link, but lateral tilting of the bucket is not possible, at least without tilting of the vehicle. The arm and rotation link are usually not laterally tiltable relative to the vehicle to which they are attached.

There are occasions, however, when it would be very desirable to work with the bucket tilted to the left or right, such as when necessary to adjust for slope requirements or to do side-angle grading. It is, of course, undesirable and often not possible to laterally tilt the entire vehicle to achieve tilting of the bucket. This problem has been overcome with the advent of laterally tiltable buckets. Such buckets generally include a hinge adaptor which is attached to the arm and the rotation link, much in the same way buckets were directly attached in the past. The adaptor serves as a hinge and pivotally supports a bucket for lateral rotation of the bucket about a hinge axis which is generally aligned with the forward rotation plane through which the bucket is conventionally rotated. This allows the bucket to be laterally tilted from side to side. Control of the amount of lateral tilting is accomplished using a double-acting cylinder which extends laterally between the hinge adaptor and the bucket to selectively cause the bucket to rotate about the hinge axis. Extension of the double-acting cylinder causes the bucket to rotate to one side, and retraction of the cylinder causes it to rotate to the other side.

To achieve the desirable range of tilting, such an arrangement has required a relatively long, double-acting cylinder. As such, only relatively wide buckets could accommodate the amount of extension and retraction of the double-acting cylinder required to laterally tilt the bucket to the extent desired. The more tilting required, the greater the space required to handle the double-acting cylinder to be used, because greater extension is needed. Of course, space limitations not only limit the length of the double-acting cylinder which can be used, but also the torque output achievable with the cylinder. The use of a bucket that is wide enough to accommodate the elongated double-acting cylinders does not always solve these problems, because certain type jobs can best be done only with relatively narrow buckets. Typically, it is desired to have tiltable buckets tilt 45 degrees to the left and to the right relative to the vertical.

The need for a laterally tiltable bucket assembly which uses a relatively narrow width bucket has been largely met by the present inventor's Tiltable Bucket Assembly described in U.S. Pat. No. 4,906,161. That bucket assembly can transmit large torque to the bucket and firmly hold the bucket at the desired tilt angle.

That bucket assembly does not, however, provide means for quickly disconnecting the bucket or other tool from the vehicle arm and rotation link, but rather requires the operator to remove the pins which hold the bucket in place and re-insert them for the next tool to be attached. This is a slow and sometimes difficult process.

It will, therefore, be appreciated that there has been a significant need for a laterally tiltable bucket assembly which can quickly and easily disconnect and re-connect the bucket or another tool. The present invention fulfills this need and further provides other related advantages.

SUMMARY OF THE INVENTION

The present invention resides in a fluid-powered actuator, usable with a vehicle having an arm and a rotation link associated therewith for rotation of a tool in a first plane defined by movement of the rotation link relative to the arm. The arm and the rotation link each has an attachment member located toward a free end thereof. The tool with which the actuator is usable has a first tool attachment member and a second tool attachment member located away from the first tool attachment member. The first and second tool attachment members are arranged in general parallel alignment with the first plane. In one embodiment of the invention, the tool is a bucket and the invention is in the form of a fluid-powered laterally tiltable bucket assembly.

The tool actuator comprises a body having a longitudinal axis and first and second ends. An attachment bracket is rigidly attached to the body and has an external first bracket attachment member located generally along the body axis for pivotal attachment of the vehicle arm by the vehicle arm attachment member and an external second bracket attachment member located generally along the body axis away from the first bracket attachment member for pivotal attachment of the rotation link by the rotation link attachment member. The first and second bracket attachment members are selectively detachable from the arm and rotation link attachment members. When the arm and rotation link attachment members are attached to the attachment bracket, movement of the rotation link causes the body to rotate about the vehicle arm with movement of the longitudinal axis of the body in general parallel alignment with the first plane. The tool actuator is selectively detachable from the vehicle arm and the rotation link.

The tool actuator further includes an output shaft rotatably disposed within the body in general coaxial arrangement with the body. The shaft has a first shaft end portion extending at least to the first body end and a second shaft end portion extending toward the second body end. The first shaft end portion has a first shaft attachment member which is releasably coupled to the first tool attachment member.

The tool actuator also includes a member which is longitudinally extendable relative to the second shaft end portion. The extendable member has a second shaft attachment member which is releasably coupled to the second tool attachment member. The extendable member is selectively extendable between a locking position with the first and second shaft attachment members positioned to attach the tool to the shaft for rotation with the shaft through a second plane extending laterally, generally transverse to the first plane, and a release position with the first and second shaft attachment members positioned to allow disconnection of the tool from the shaft. The tool actuator further includes a selectively operable member actuator for selectively moving the extendable member between the locking and release positions.

The tool actuator also includes a linear-to-rotary torque transmitting member mounted for longitudinal movement within the body in response to selective application of pressurized fluid thereto. The torque-transmitting member engages the body and the shaft to translate longitudinal movement of the torque-transmitting member into rotational movement of the shaft relative to the body. In such manner, the tool is rotatable in the first plane and laterally tiltable in the second plane.

In a first embodiment of the invention, the second shaft end portion has a longitudinally extending aperture therein with an open end toward the second body end. The extendable member has a first end portion movably disposed within the shaft aperture and a second end portion extending out of the shaft open end. The second shaft attachment member is attached to the extendable member second end portion.

In this first embodiment of the invention, the first shaft end portion has an interiorly threaded aperture, and the member actuator includes a screw having a threaded end portion threadably received in the shaft threaded aperture. The screw also includes a mounting portion to which the extendable member is mounted for longitudinal movement with the screw. The screw is selectively rotatable relative to the shaft to rotate the screw threaded portion within the shaft threaded aperture and thereby selectively move the screw longitudinally relative to the shaft. The screw threaded portion has a sufficient length when rotated to longitudinally move the extendable member between the locking and release positions.

In this first embodiment of the invention, the first shaft attachment member includes a pair of laterally spaced-apart forks facing generally toward the second body end and the second shaft attachment member includes a pair of laterally spaced-apart forks facing generally toward the first body end. The pairs of forks are positioned to each engage and retain one of a pair of laterally extending pins which comprises the first and second tool attachment members. The pairs of forks are positioned to each engage and retain one of the pins for rotation and lateral tilting of the tool when the extendable member is in the locking position. The pair of forks comprising the second shaft attachment member is positioned to disengage the corresponding pin when the extendable member is in the release position to allow removal of the tool.

In a second embodiment of the invention, the second shaft attachment member is longitudinally extendable relative to the second shaft end portion and is releasably coupled to the second tool attachment member. The second shaft attachment member is selectively longitudinally movable between a locking position and a release position. The second shaft attachment member is at least partially disposed within the shaft aperture. The member actuator selectively moves the second shaft attachment member longitudinally within the shaft aperture sufficiently to move the second shaft attachment member between the locking and release positions. The second shaft attachment member moves into a retracted position at least partially within the shaft aperture to disengage from the second tool attachment member when moved to the released position, and into a projecting position projecting at least partially out of the shaft aperture open end to engage the second tool attachment member when moved to the locking position.

With this embodiment of the invention, the second tool attachment member includes a receiver aperture, and the second shaft attachment member includes a locking pin sized to fit within the receiver aperture when moved to the locking position.

In the second embodiment, the shaft aperture includes an interiorly threaded aperture portion and the member actuator is a threaded member having a threaded member portion threadably received in the shaft threaded aperture portion. The second shaft attachment member is in engagement with the threaded member for longitudinal movement therewith. The threaded member is selectively rotatable relative to the shaft to rotate the threaded member portion within the shaft threaded aperture portion and thereby selectively move the threaded member and the second shaft attachment member longitudinally relative to the shaft. The threaded member portion has a sufficient length when rotated to longitudinally move the second shaft attachment member between the locking and release positions.

The threaded member is attached to the second shaft member to transmit rotational forces therebetween and the second shaft attachment member has a terminal end toward the shaft aperture open end engageable by a tool for selectively rotating the threaded member to move the second shaft attachment member between the locking and release positions.

The member actuator includes a spring positioned in the shaft aperture and engaging the threaded member to apply a longitudinal force between the shaft and the threaded member to inhibit unintended rotation of the threaded member within the shaft threaded aperture portion during operation of the tool actuator. The threaded member and the second shaft attachment member are formed as an integral unit.

In a third embodiment of the invention, the member actuator includes a piston positioned within the shaft aperture in engagement with the second shaft attachment member for longitudinal movement of the second shaft attachment member with the piston into at least one of the locking or release positions in response to the selected application of pressurized fluid to the piston. The member actuator includes a spring positioned within the shaft aperture and engaging the piston to apply a longitudinal force between the shaft and the piston to longitudinally move the second shaft attachment member into the other of the locking or release positions. In this third embodiment of the invention, upon the application of pressurized fluid to the piston, the piston moves the second shaft attachment member to the release position with the second shaft attachment member retracted sufficiently within the shaft aperture to disengage from the second tool attachment member. Upon the release of pressurized fluid to the piston, the spring moves the second shaft attachment member to the locking position with the second shaft attachment member extending out of the shaft aperture sufficiently to engage the second tool attachment member. In this embodiment of the invention, the piston and the second shaft attachment member are formed as an integral unit.

Other features and advantages of the invention will become apparent from the following detailed description, taken in conjunction with the accompanying drawings.

DETAILED DESCRIPTION OF THE INVENTION

Figure 1:
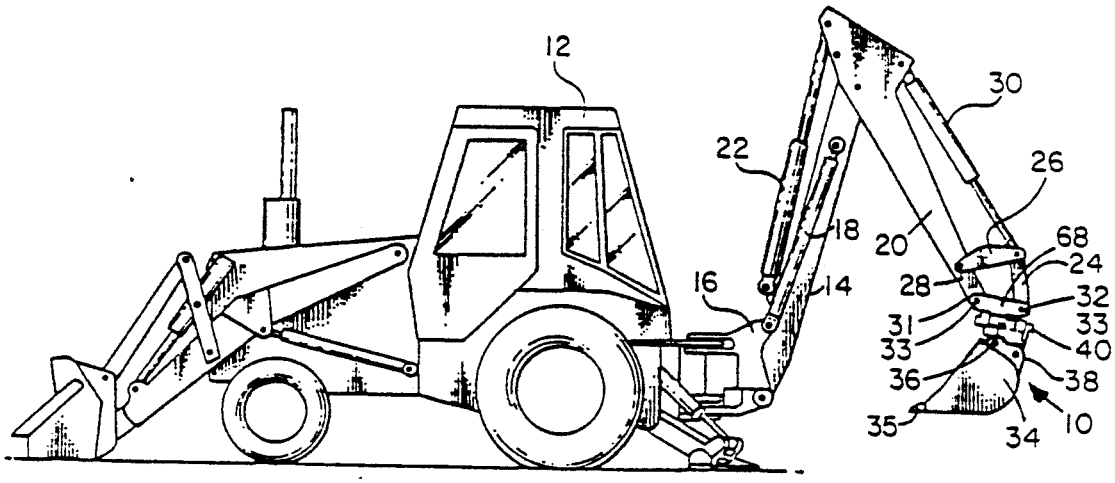
FIG. 1 is a left side elevational view of a backhoe shown with a laterally tiltable bucket assembly having a quick disconnect bucket actuator embodying the present invention.
Figure 2:
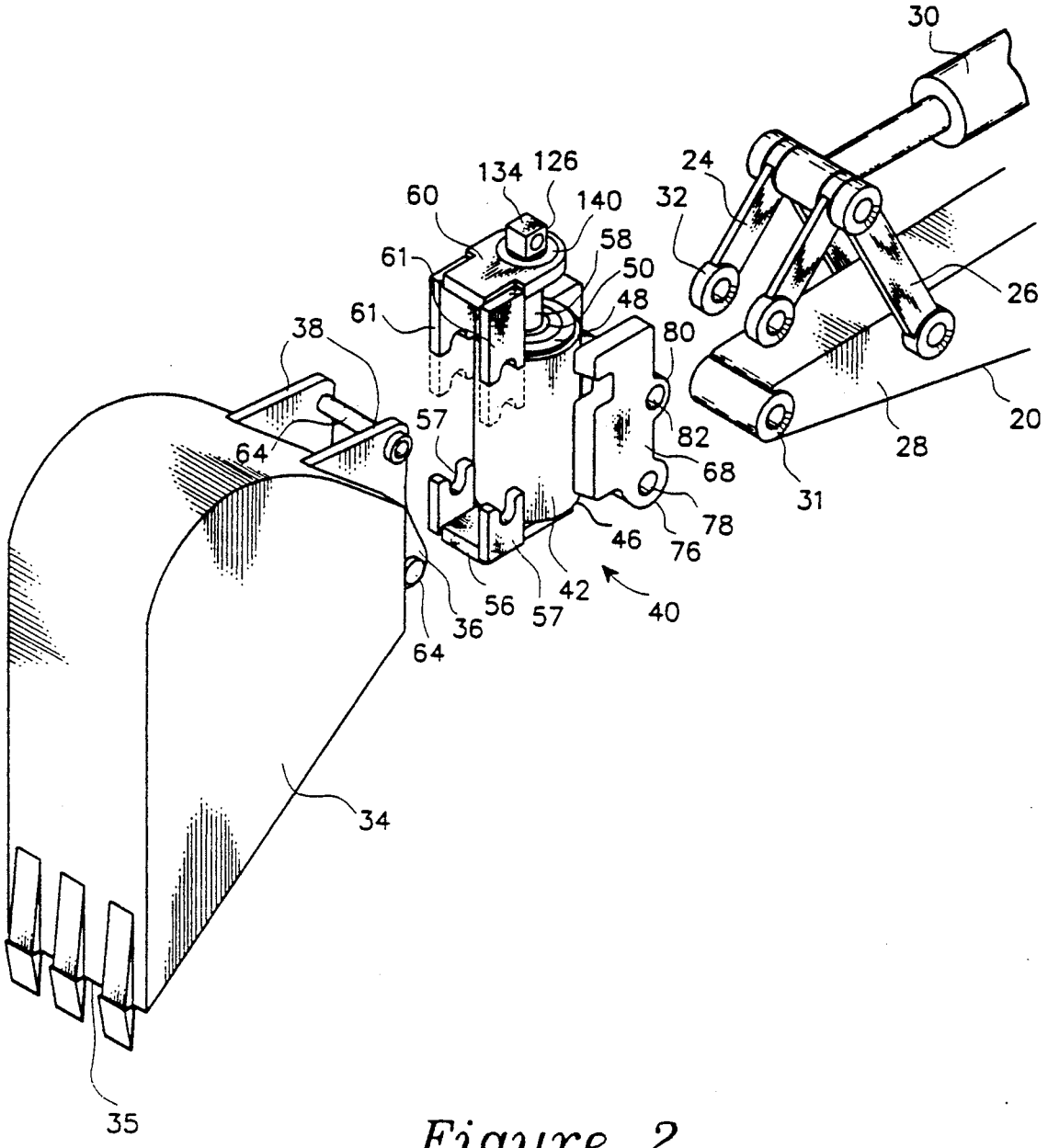
FIG. 2 is an enlarged, right side perspective view of the bucket assembly of FIG. 1 with the bucket disconnected from the bucket actuator and the bucket actuator disconnected from the arm and rotation link of the backhoe.
Figure 3:
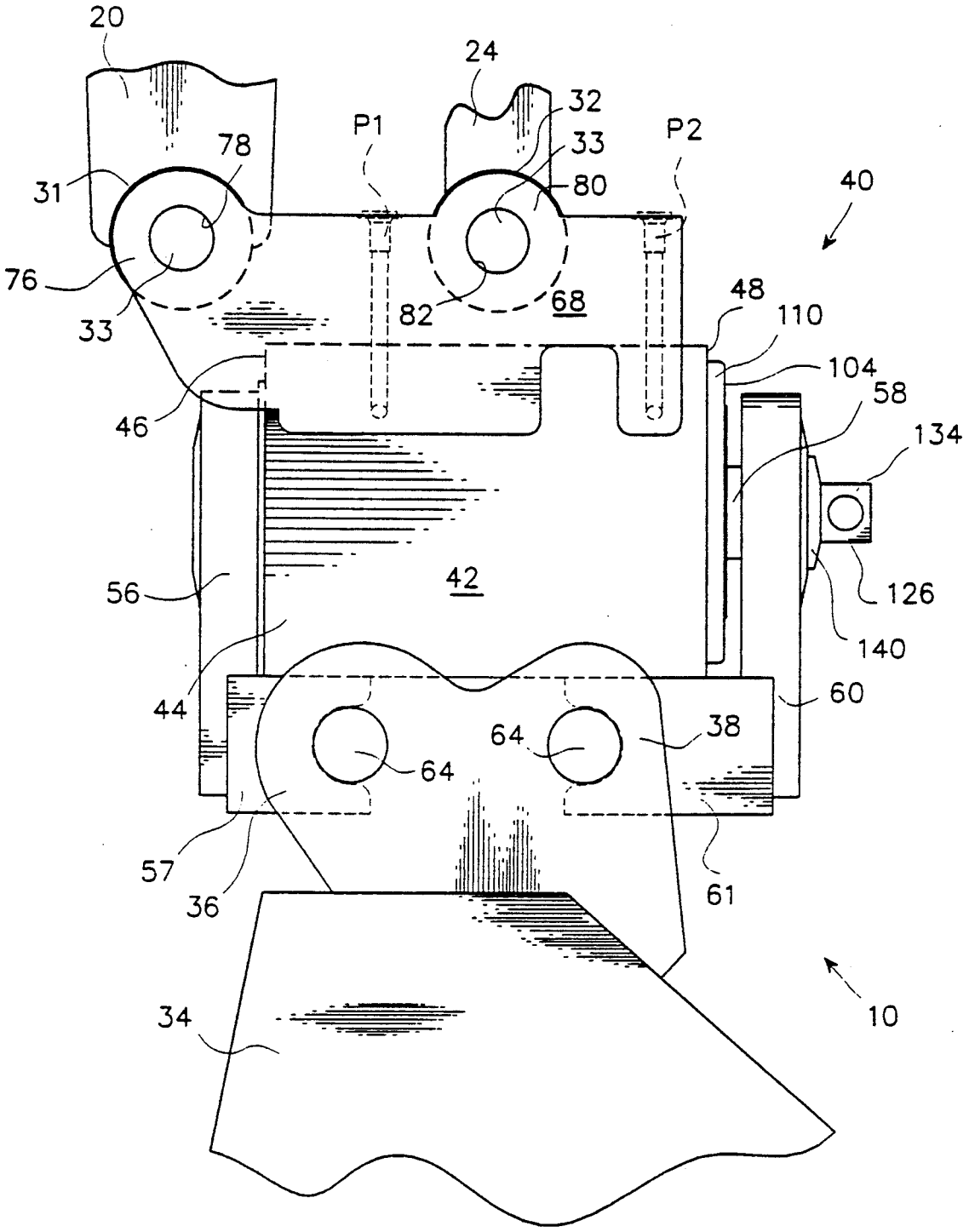
FIG. 3 is an enlarged, fragmentary, left side elevational view of the bucket assembly of FIG. 1.

As shown in the drawings for purposes of illustration, the present invention is embodied in a fluid-powered, laterally tiltable bucket assembly, indicated generally by reference numeral 10 . As shown in FIG. 1, the bucket assembly is usable with a vehicle 12, such as the illustrated backhoe or any excavator or other vehicle that might use a bucket or other tool as a work implement. The vehicle 12 has a first arm 14 which is pivotally connected by one end to a base member 16. A pair of hydraulic cylinders 18 (only one being shown in FIG. 1) is provided for raising and lowering the first arm in a generally forwardly extending vertical plane with respect to the base member 16. A second arm 20 is pivotally connected by one end to an end of the first arm 14 remote from the base member 16. A hydraulic cylinder 22 is provided for rotation of the second arm 20 relative to the first arm 14 in the same vertical forward rotation plane as the first arm operates.

The base member 16 is pivotally attached to the vehicle 12 for pivotal movement about a vertical axis so as to permit movement of the first and second arms 14 and 20 in unison to the left or right, with the first and second arms always being maintained in the forward rotation plane. It is noted that while the forward rotation plane is referred to as being forwardly extending for convenience of description, as the base member 16 is pivoted the forward rotation plane turns about the vertical pivot axis of the base member and thus to a certain extent loses its forward-to-rearward orientation, with the plane actually extending laterally should the base member be sufficiently rotated.

A rotation link 24 is pivotally connected through an interconnecting link 26 to an end portion 28 of the second arm 20 remote from the point of attachment of the second arm to the first arm 14. A hydraulic cylinder 30 is provided for selective movement of the rotation link 24 relative to the second arm 20.

As is conventional, a free end portion 31 of the second arm 20 and a free end portion 32 of the rotation link 24 each has a transverse aperture therethrough for connection of the second arm and the rotation link to a conventional bucket using a pair of selectively removable attachment pins 33. The attachment pins 33 are insertable in the apertures to pivotally connect the conventional bucket to the second arm and the rotation link. When using the conventional bucket, this permits the bucket to be rotated about the attachment pin of the second arm 20 upon movement of the rotation link 24 relative to the second arm as a result of extension or retraction of the hydraulic cylinder 30 to rotate the bucket in the forward rotation plane defined by the first and second arms 14 and 20.

In the presently preferred embodiment of the invention, a conventional bucket 34 of relatively narrow width is utilized. The bucket has a toothed forward working edge 35 (see FIG. 1) extending laterally, generally transverse to the forward rotation plane of the bucket. The bucket 34 further includes a first bucket clevis 36 located toward the bucket working edge 35 and a second bucket clevis 38 located rearwardly away from the first bucket clevis. The first and second bucket clevises are in general parallel alignment with the forward rotation plane of the bucket. It should be understood that the present invention may be practiced using other tools as work implements, and is not limited to just operation with buckets.

Figure 4:
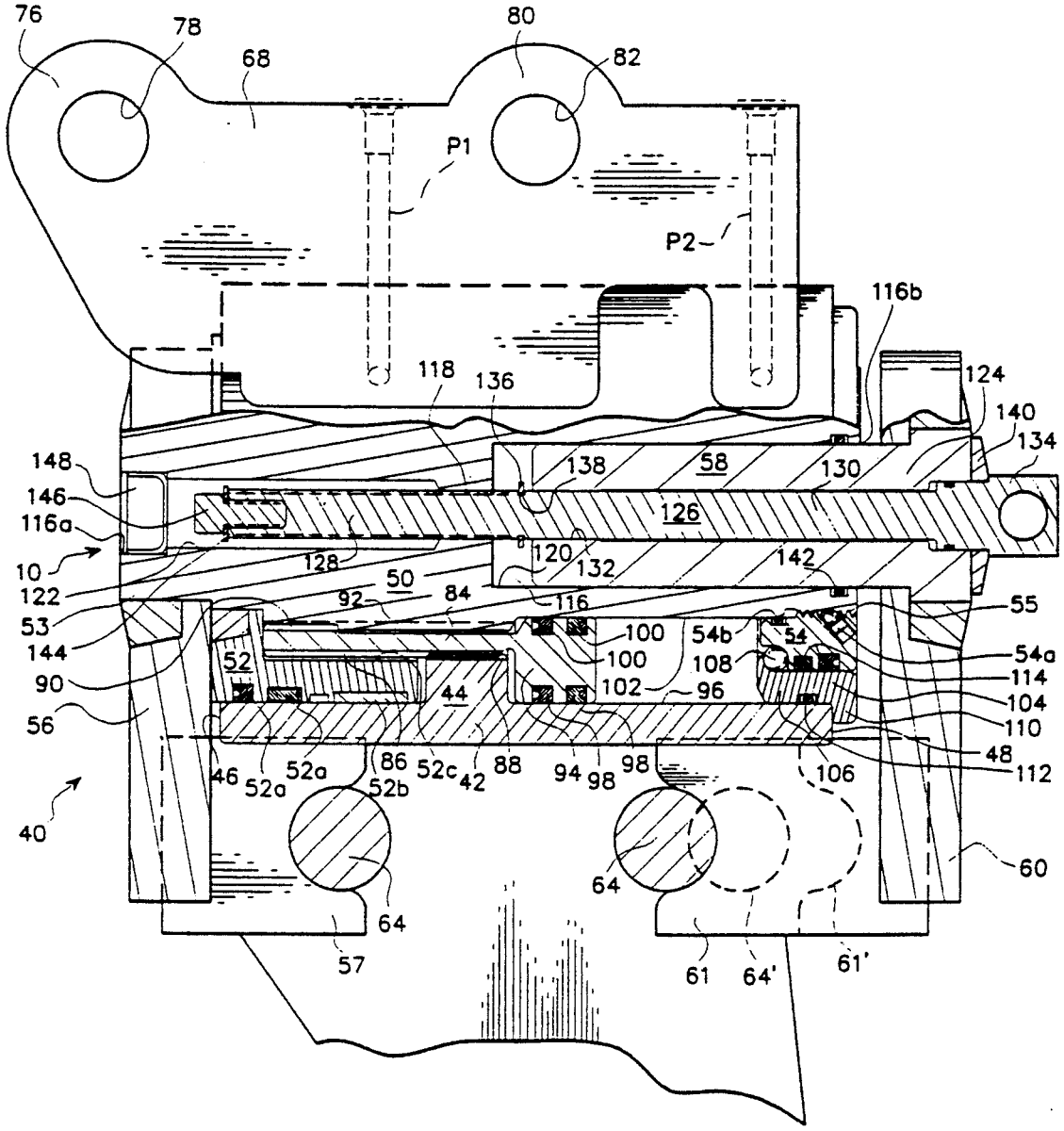
FIG. 4 is an enlarged, left side elevational view of the bucket actuator of FIG. 1 shown in partial sections taken substantially along the line of 4—4 of FIG. 5.
Figure 5:
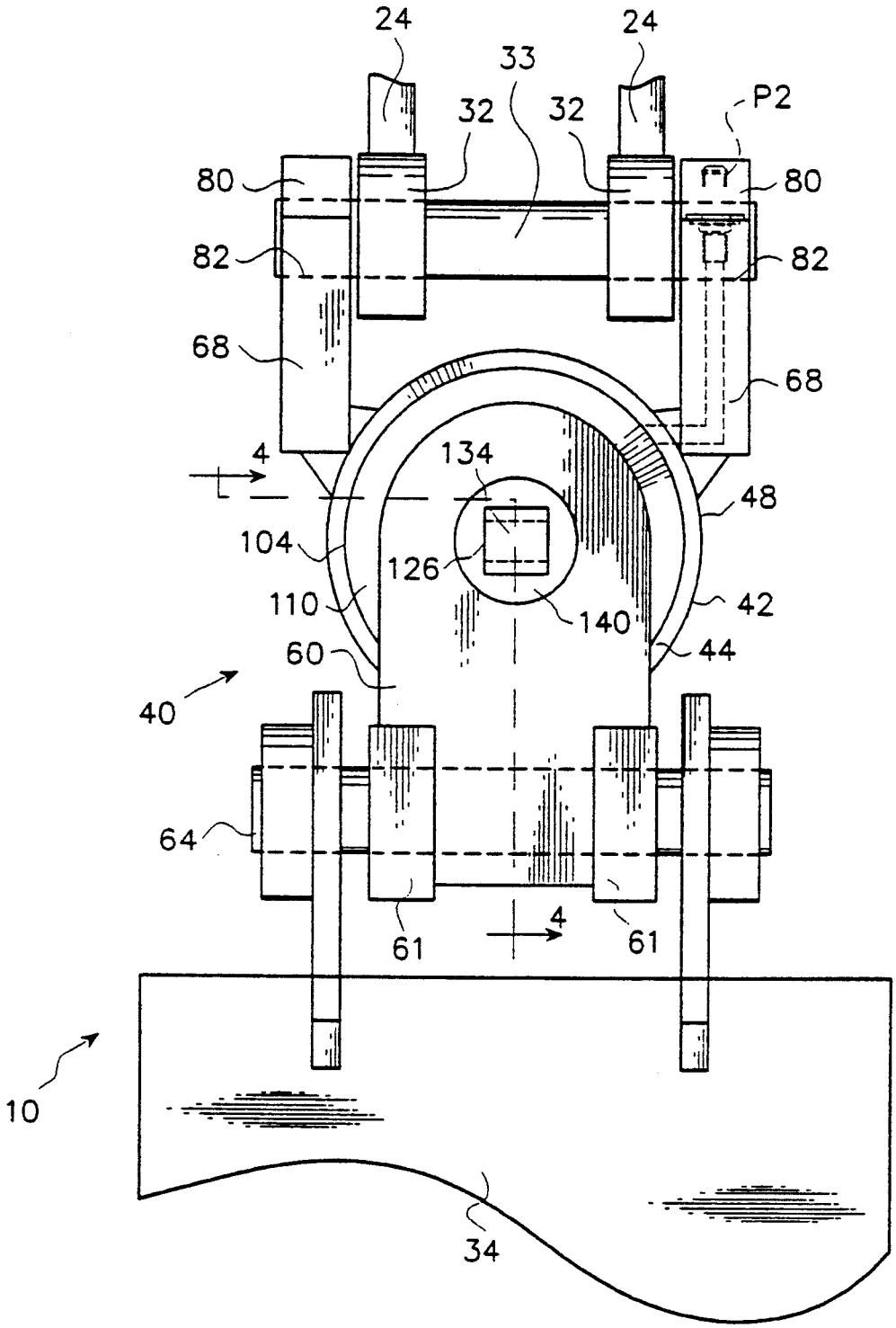
FIG. 5 is an enlarged, fragmentary, rear elevational view of the bucket assembly of FIG. 1.
Figure 6:
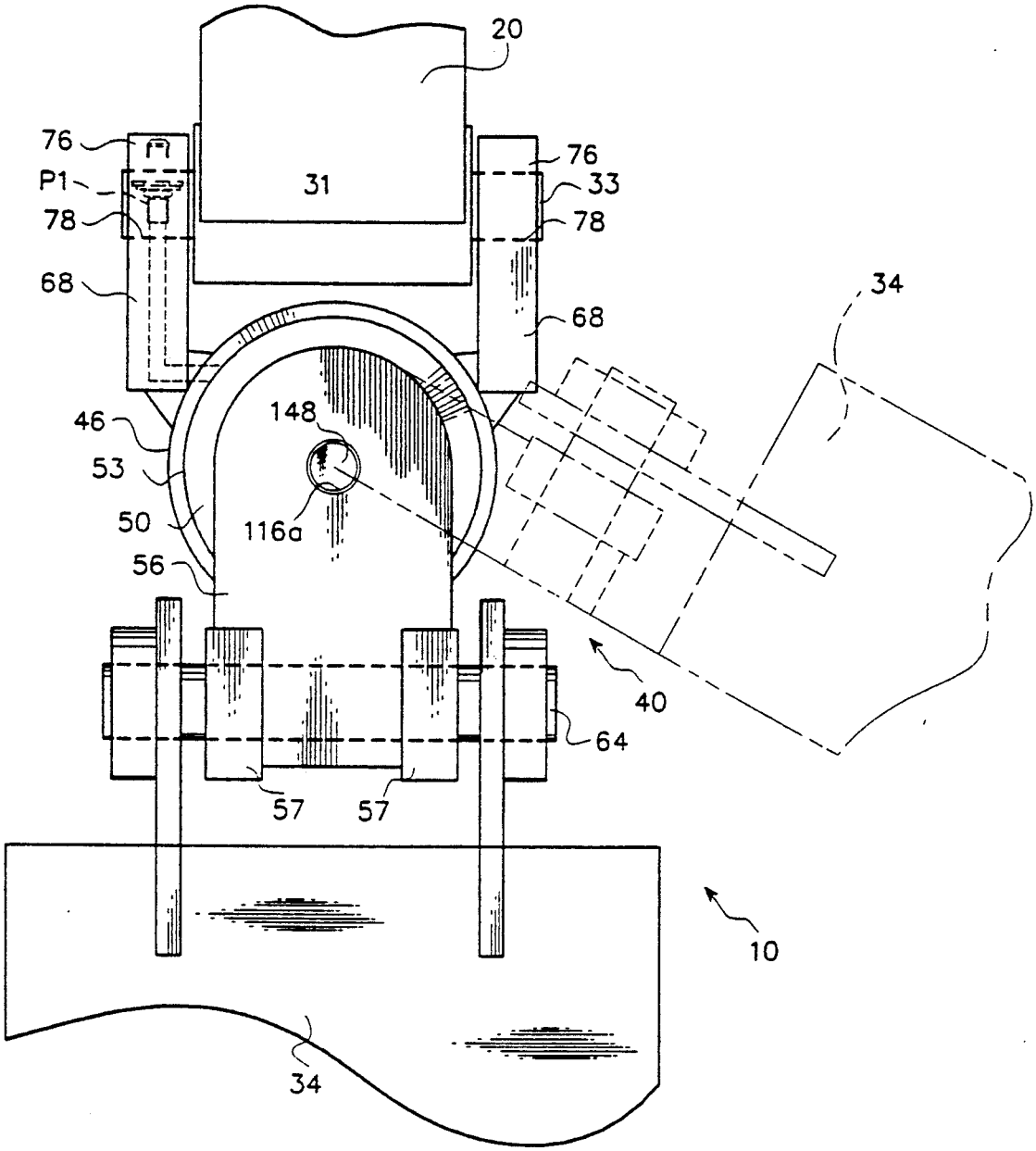
FIG. 6 is an enlarged, fragmentary, front elevational view of the bucket assembly of FIG. 1, with the bucket shown in phantom line rotated to a laterally tilted position.

The bucket assembly 10 of the present invention further includes a rotary actuator 40. As best shown in FIG. 4, the actuator 40 has an elongated housing or body 42 with a cylindrical sidewall 44 and first and second ends 46 and 48, respectively. An elongated rotary drive or output shaft 50 is coaxially positioned within the body 42 and supported for rotation relative to the body.

The shaft 50 extends the full length of the body 12, and has a flange portion 52 at the first body end 46, and an exteriorly extending shaft portion 53 extending exterior of the body at the first body end. The shaft 50 has an annular carrier or shaft nut 54 threadably attached thereto at the second body end 48. The shaft nut 54 has a threaded interior portion threadably attached to a correspondingly threaded perimeter portion 55 of the shaft 50 and the shaft nut rotates with the shaft. The shaft nut 54 is locked in place against rotation by a set screw 54*a*. A seal 54*b* is disposed between the shaft nut 54 and the shaft 50 to provide a fluid-tight seal therebetween. Seals 52*a* are disposed between the shaft flange portion 52 and the body sidewall 44 to provide a fluid-tight seal therebetween. A radial bearing 52*b* is disposed between the shaft flange portion 52 and the body sidewall 44 to support the shaft 50 against radial thrust loads.

A first attachment flange 5 is positioned outward of the body 42 at the first body end 46 and is fixedly attached to the exteriorly extending shaft portion 53 at the first body end for rotation with the shaft relative to the body 42. The first attachment flange 56 abuts against the outward end face of the shaft flange portion 52 for support. The first attachment flange 56 has the rotational drive of the shaft 50 transmitted thereto so as to provide the torque needed for tilting the bucket 34 to the desired lateral tilt angle and for holding the bucket in that position while the bucket performs the desired work. The first attachment flange 56 does not move axially relative to the body 12.

The first attachment flange 56 extends radially beyond the body sidewall 44 downwardly toward the bucket 34, and terminates in a pair of laterally spaced-apart forks 57 which faces generally toward the second body end 48.

As will be described in greater detail below, a member 58 is provided at the second body end 48 which is selectively extendable relative to the shaft 50. The member 58 has a second attachment flange 60 fixedly attached thereto. The second attachment flange 60 is positioned outward of the body 12 at the second body end 48 for rotation with the shaft 50 relative to the body 42, as does the first attachment flange 56. The second attachment flange 60 extends radially beyond the body sidewall 44 downwardly toward the bucket 34, and terminates in a pair of laterally spaced-apart forks 61 which faces generally toward the first body end 46.

While the second attachment flange 60 is securely attached to the extendable member 58, and through the extendable member to the shaft 50, it is not constructed to transmit rotational drive to the bucket 34 to provide the torque needed to tilt the bucket, as is the first attachment flange 56. Nevertheless, the second attachment flange 60 will rotate with the shaft 50 as a result of the rotational drive transmitted thereto through the first attachment flange 56 via the bucket 34 to which the first and second attachment flanges 56 and 60 are attached. The second attachment flange 60 primarily serves to transmit the rotational force to the bucket 34 produced by the movement of the rotation link 24 relative to the second arm 20 in order to cause the bucket to be selectively rotated through the forward rotation plane. The entire bucket assembly 10, and hence the bucket 34 comprising a part thereof, rotates about the attachment pin 33 of the second arm 20 as the rotation link 24 is moved relative to the second arm by the hydraulic cylinder 30. As will be described below, the body 42 of the actuator 40 is pivotally attached to the second arm 20 and the rotation link 24, much in the same manner as a conventional bucket would be attached.

The attachment of the bucket 34 to the first and second attachment flanges 56 and 60 will be described for the bucket being attached with its working edge 35 located toward the vehicle 12, but it should be understood that the bucket and most any other tool used with the actuator 40 can be reversed. The forks 57 of the first attachment flange 56 are spaced apart and have grooves sized for mating with the corresponding first bucket clevis 36, and the forks 61 of the second attachment flange 60 are spaced apart and have grooves sized for mating with the corresponding second bucket clevis 38 for releasable attachment of the bucket 34 to the actuator 40 at a position therebelow. Each of the first and second bucket clevises 36 and 38 includes a laterally extending pin 64. Each fork of the pair of forks 57 is oriented with its groove opening toward a corresponding fork of the other pair of forks 61. The grooves are sized to receive the pins 64 of the first and second clevises 36 and 38 therein and securely, but releasably, hold the bucket 34 in place for work, as shown in FIG. 1.

As will be described below, when the extendable member 58 is retracted to a locking position, with the second attachment flange 60 moved toward the first attachment flange 56, the pins 64 of the bucket 34 are clamped between the pairs of forks 57 and 61. When the extendable member 58 is extended to a release position, with the second attachment flange 60 moved away from the first attachment flange 56 greater than the distance between the pins 64 of the bucket 34, the pins are released from the pairs of forks 57 and 61, and the bucket 34 can be removed and replaced with another tool. By the use of selectively extendable member 58, the bucket 34 can be quickly and conveniently removed from the actuator 40 for attachment of another tool, or reversal of the bucket. This allows for quick and easy attachment of a different size or style bucket or other tool to the actuator as the job demands. Also, the extendable member 58 can be adjusted to move the pairs of forks 57 and 61 apart by selected distances of varying amounts to accommodate buckets and other tools with pins 64 having different inter-pin spacing, and thereby still securely clamp the pins between the pairs of forks.

It should be noted that while the forks 57 and 61 are shown and described as being inwardly facing, for buckets and other tools with larger spacing between the pins 64 the forks can be reversed. When reversed, the forks would be positioned between the pins 64 and the extendable member 58 extended axially outward of the shaft 50 to reach the locking position with the forks securely engaging the pins, and retracted to release the pins. With such an arrangement, other changes in the internal design of the actuator 40 would be made since the larger force which is required for the forks 57 and 61 to securely engage the pins 64 would be when extending the extendable member 58, rather than when retracting the extendable member, as is the case with the illustrated embodiment of the invention.

A pair of attachment brackets 68 is used to detachably connect the body 42 to the second arm 20 and the rotation link 24 in a position therebelow in general alignment with the forward rotation plane. The attachment brackets 68 are rigidly attached to the body sidewall 44. The attachment brackets 68 form a first attachment clevis 76 with an aperture 78 therein sized to receive one of the attachment pins 33 to pivotally connect the body 42 to the vehicle second arm 20 at its free end portion 31, and a second attachment clevis 80 with an aperture 82 therein sized to receive the other of the attachment pins 33 to pivotally connect the body to the rotation link 24 at its free end portion 32. By the use of selectively removable attachment pins 33, the bucket assembly 10 can be quickly and conveniently removed from the second arm 20 and the rotation link 24 when use of the bucket assembly is not desired.

With the tiltable bucket assembly 10 of the present invention, a compact, fluid-powered actuator 40 is used with a design which requires far less space, particularly with respect to the size in the lateral direction compared to when using double-acting cylinders to rotate a tilt bucket. This allows the construction of a tiltable bucket assembly with a very narrow width bucket. Furthermore, the bucket assembly can be used with conventional buckets and thus can be retrofitted onto vehicles with existing buckets without requiring purchase of a new bucket.

An annular piston sleeve 84 is coaxially and reciprocally mounted within the body 42 coaxially about the shaft 50. The piston sleeve 84 has outer helical splines 86 over a portion of its length which mesh with inner helical splines 88 of a splined intermediate interior portion of the body sidewall 44. The piston sleeve 84 is also provided with inner helical splines 90 which mesh with outer helical splines 92 provided on a splined end portion of the shaft 50 toward the first body end 46. The shaft flange portion 52 has a circumferentially extending recess **52*c* which opens facing toward the second body end 48 and is sized to receive a lengthwise portion of the spliced piston sleeve 84 therein when it moves axially toward the first body end 46**. It should be understood that while helical splines are shown in the drawings and described herein, the principle of the invention is equally applicable to any form of linear-to-rotary motion conversion means, such as balls or rollers.

In the illustrated embodiment of the invention, the piston sleeve 84 has an annular piston head 94 positioned toward the second body end 40 with the shaft 50 extending therethrough. The piston head 94 is slidably maintained within the body 42 for reciprocal movement, and undergoes longitudinal and rotational movement relative to a smooth interior wall surface 96 of the body sidewall 44, as will be described in more detail below.

Seals 98 are disposed between the piston head 94 and the interior wall surface 96 of the body sidewall 44 to provide a fluid-tight seal therebetween. Seals 100 are disposed between the piston head 94 and a smooth exterior wall surface 102 of the shaft 50 to provide a fluid-tight seal therebetween.

As will be readily understood, reciprocation of the piston head 94 within the body 42 occurs when hydraulic oil, air or any other suitable fluid under pressure selectively enters through one or the other of a first port P1 which is in fluid communication with a fluid-tight compartment within the body to a side of the piston head toward the first body end 46 or through a second port P2 which is in fluid communication with a fluid-tight compartment within the body to a side of the piston head toward the second body end 48. As the piston head 94 and the piston sleeve 84, of which the piston head is a part, linearly reciprocates in an axial direction within the body 40, the outer helical splines 86 of the piston sleeve engage or mesh with the inner helical splines 88 of the body sidewall 44 to cause rotation of the piston sleeve. The linear and rotational movement of the piston sleeve 84 is transmitted through the inner helical splines 90 of the piston sleeve to the outer helical splines 92 of the shaft 50 to cause the shaft 50 to rotate. The smooth wall surface 102 of the shaft 50 and the smooth wall surface 96 of the body sidewall 44 have sufficient axial length to accommodate the full end-to-end reciprocating stroke travel of the piston sleeve 84 within the body 42. Longitudinal movement of the shaft 50 is restricted, thus all movement of the piston sleeve 84 is converted into rotational movement of the shaft 50. Depending on the slope and direction of turn of the various helical splines, there may be provided a multiplication of the rotary output of the shaft 50.

The application of fluid pressure to the first port P1 produces axial movement of the piston sleeve 84 toward the second body end 48. The application of fluid pressure to the second port P2 produces axial movement of the piston sleeve 84 toward the body first end 46. The actuator 40 provides relative rotational movement between the body 42 and shaft 50 through the conversion of linear movement of the piston sleeve 84 into rotational movement of the shaft, in a manner well known in the art. The shaft 50 is selectively rotated by the application of fluid pressure, and the rotation is transmitted to the bucket 34 through the first attachment flange 56 to selectively tilt the bucket laterally, left and right.

The actuator 40 includes an insert 104 having an annular sidewall portion 106 with a central aperture. The sidewall portion 106 of the insert 104 is coaxially positioned within the body 40 at the second body end 48, and has its central aperture sized to rotatably receive the shaft nut 54 therein. An exterior ball race is formed on the shaft nut 54, and an interior ball race is formed on the insert sidewall 106 portion confronting and corresponding to the shaft nut ball race. The shaft nut and second insert ball races extend circumferentially, fully about the shaft nut 50 and form a set of races. A plurality of steel bearings 108 are seated in the set of races and rotatably support the shaft nut 54 for rotational movement of the shaft 50 relative to the body 42. The set of races with the ball bearings 108 therein serves to support the shaft 50 against moment loads and both radial and axial thrust loads.

The insert 104 has a circumferentially extending flange 110 positioned exterior of the body 42 and projecting outward beyond the second body end 48 to engage an endwall of the body sidewall 44 and prevent inward axial movement of the insert during fluid-powered operation of the actuator 40.

A seal 112 is disposed between the insert 104 and the body sidewall 44 A pair of seals 114 is disposed between the insert 104 and the shaft nut 54. The seals 112 and 114 provide fluid-tight seals which prevent fluid leakage from the body 42.

The shaft 50 has an axially extending central aperture 116 which extends fully between the first and second body ends 46 and 48 and terminates at the first body end 46 in an opening **116*a* and at the second body end 46 in an opening 116*b*. The shaft aperture 116 has an interiorly threaded intermediate portion 118, an enlarged smooth-walled portion 120 which extends from the threaded aperture portion to the opening 116*b* at the second body end 48, and a portion 122 which extends from the threaded aperture portion to the opening 116*a* at the first body end 46. The extendable member 58 is slidably disposed in the smooth-walled aperture portion 120 and extends out of the opening 116*b* at the second body end 48**.

The second attachment flange 60 is located at an end portion 124 of the extendable member 58 which is positioned outward of the body 42. Except as described below, the extendable member 58 is freely axially movable and rotatable within the smooth-walled aperture portion 120. The rotation of the extendable member 58 is limited by its connection through the bucket 34 to the first attachment flange 56 which is rigidly connected to the shaft 50 at the first body end 46. The axial movement of the extendable member 58 is limited by an actuator screw 126 on which it is mounted for axial travel therewith.

The screw 126 is coaxially received in the shaft aperture 116 and has a threaded end portion 128 which is threadably received in the correspondingly threaded aperture portion 118. The threaded end portion 128 of the screw 126 extends into the aperture portion 122 of the shaft aperture 116 and the aperture portion has sufficient axial length to accommodate the axial travel of the screw 126 toward the first body end 46 that results when the screw is rotated.

The screw 126 also has a smooth-walled portion 130 which extends from its threaded end portion 128 through a smooth-walled central aperture 132 in the extendable member 58 and terminates in a head 134 located axially outward of the second attachment flange 60. The extendable member 58 is retained on the smooth-walled portion 130 of the screw 126 against axial movement toward the first body end 46 by a retainer clip 136 which is received in a circumferential groove 138 the screw, and against axial movement toward the second body end 48 by the head 134. A spring washer 140 is disposed between the head 134 and the extendable member 58. A seal 142 is disposed between the smooth-walled portion 130 of the screw 126 and the smooth-walled central aperture 132 of the extendable member 58 to keep contaminants out.

The extendable member 58 is selectively axially movable to selectively extend the extendable member relative to the shaft 50 by rotation of the screw 126. The rotation of the screw 126 moves the extendable member 58 between the locking position, with the second attachment flange 60 adjacent to the second body end 48 so that the pairs of forks 57 and 61 are close enough together to clamp the pins 64 of the bucket 34 securely therebetween, and the release position, with the second attachment flange moved axially a sufficient distance away from the second body end so that the pairs of forks 57 and 61 are spaced apart sufficiently to release the pins 64 of the bucket 34.

The screw 126 is rotated to selectively extend or retract the extendable member 58 by use of a tool (not shown) which is sized to operatively engage the head 134 of the screw. When the screw 126 is rotated to advance the screw inward toward the first body end 46, the head 134 through the washer 140 forces the extendable member 58 into the smooth-walled portion 120 of the shaft aperture 116 to retract the extendable member until it reaches the locking position with the pairs of forks 57 and 61 securely clamping the pins 64 of the bucket 34 therebetween. Of course, the exact position of the "locking position" relative to the shaft 50 is dependent upon the particular inter-pin spacing of the particular bucket being used. The locking position changes when buckets or other tools with different inter-pin spacings are used.

The maximum inter-pin spacing that the extendable member 58 can accommodate is illustrated by the placement of the pin 64' shown in phantom line in FIG. 4. The minimum inter-pin spacing that the extendable member 58 can accommodate is illustrated by the placement of the pin 64 shown in solid line in FIG. 4. These maximum and minimum inter-pin spacings are so in FIG. 4. It is noted that to allow removal of the bucket 34 when the maximum inter-pin spacing is encountered, the second attachment flange 60 must be axially moved by the extendable member 58 to position the forks 61 thereof to the position of the forks 61' shown in phantom line in FIG. 4 so that the corresponding pin 64' of the bucket 34 can clear the forks 61.

When the screw 126 is rotated to advance the screw outward toward the second body end 48, the clip 136 forces the extendable member 58 out of the smooth-walled portion 120 of the shaft aperture 116 through the opening **116*b* to extend the extendable member until it reaches the release position with the pairs of forks 57 and 61 spaced far enough apart to release the pins 64 of the bucket 34 and allow removal of the bucket and attachment of another tool, or reversal of the bucket. The exact "release position" relative to the shaft 50 is dependent on the particular inter-pin spacing of the bucket being used and changes when buckets or other tools with different inter-pin spacings are used. To prevent the rotation of the screw 126 outward so much that it clears the threads of the threaded portion 118 of the shaft aperture 116, a washer 144 is held in place by a bolt 146 on the end face of the screw threaded end portion 128. The washer 144 has a diameter which prevents it from being pulled through the threaded aperture portion 118. Access to the bolt 146 is achieved through the opening 116*a* at the first body end 46, and the opening is closed by use of a cap 148** to keep out contaminants.

For ease of understanding, the components of the alternative embodiments of the invention described hereinafter will be similarly numbered with those of the first embodiment described above when of a similar construction. Only the differences in construction will be described in detail.

Figure 7:
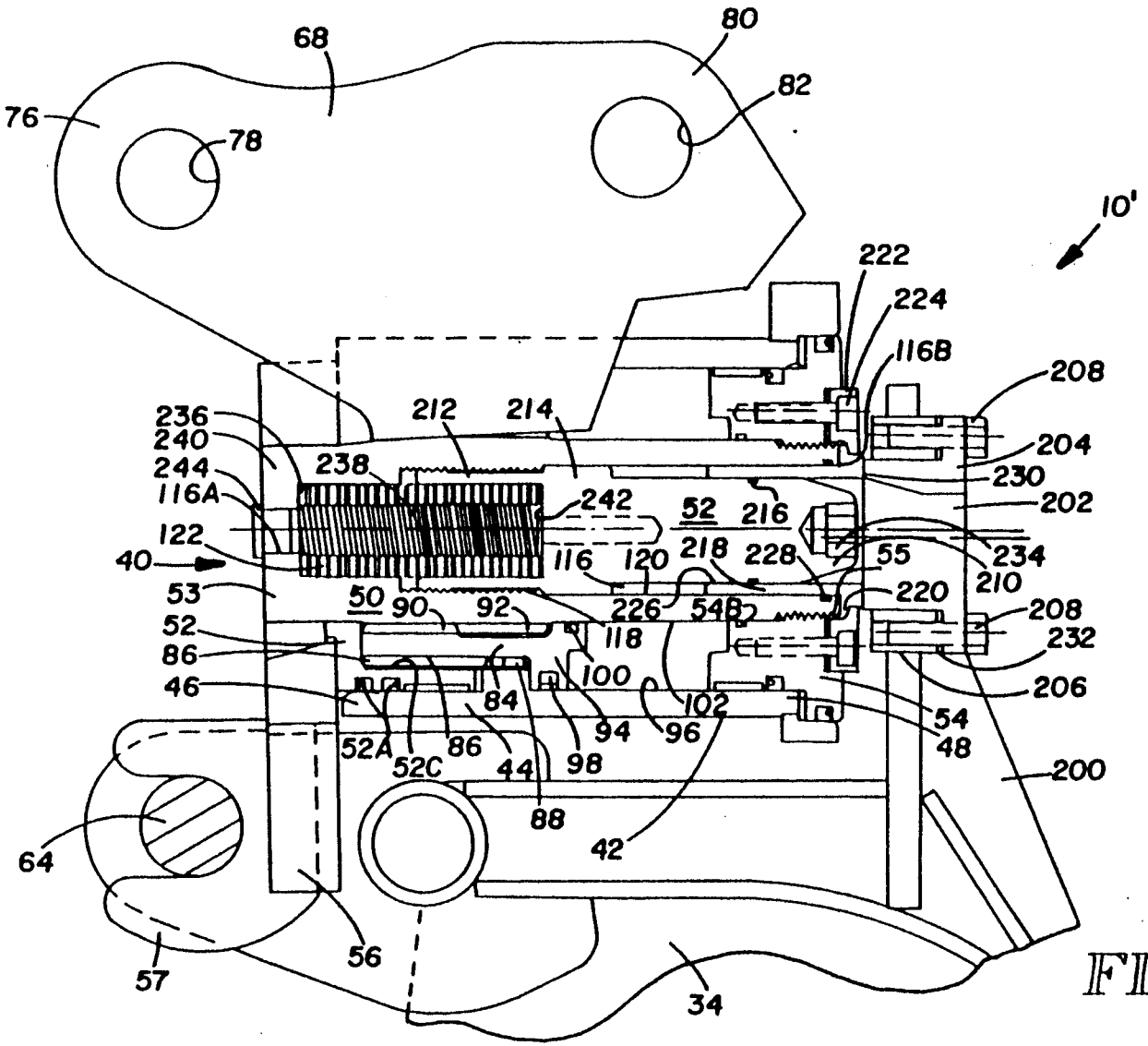
FIG. 7 is a fragmentary, left side elevational view of a first alternative embodiment of the bucket assembly of FIG. 1 showing a first alternative bucket actuator in cross-section.

A first alternative embodiment of the bucket assembly 10' is shown in FIG. 7. In this embodiment, the bucket 34 has the first bucket clevis 36 toward the bucket working edge 35, but the forks 57 of the first attachment flange 56 are reversed and face away from the second body end 48. Instead of a second bucket clevis, an attachment member 200 is located rearwardly away from the first bucket clevis 36 and is rigidly attached to the bucket 34' midway between its left and right sides. The bucket attachment member 200 is located in general parallel alignment with the forward rotation plane of the bucket and projects upward above the bucket 34. The bucket attachment member 200 includes a tapered receiver aperture 202. The receiver aperture 202 is formed in a block 204 which is attached to a head portion 206 of the bucket attachment member 200 by six threaded fasteners 208.

Rather than the forks 61 at the second body end used with the first-described embodiment of FIG. 1, the selectively extendable member 58 has a locking pin portion 210 fixedly attached thereto for insertion into the receiver aperture 202 upon extension of the selectively extended member. When the locking pin portion 210 is in seated position within the receiver aperture 202, the bucket 34 is releasably, but securely, coupled to the shaft 50 for rotation therewith. The locking pin portion 210 is tapered to match the taper of the receiver aperture 202.

As with the second attachment flange 60 used with the first described embodiment, the locking pin portion 210 is not constructed to transmit rotational drive to the bucket 34 to provide the torque needed to tilt the bucket, as is the first attachment flange 56 which carries the forks 57. Rather, the locking pin portion 210 transmits the rotational force to the bucket produced by the movement of the rotation link 24 relative to the second arm 20 of the vehicle 12 in order to cause the bucket to be selectively rotated through the forward rotation plane. Unlike with the first-described embodiment which clamps the pins 64 of the bucket 34 between the pairs of forks 57 and 61, the forks 57 receive the pin 64 of the first bucket clevis 36 in their grooves, and the locking pin portion 210 prevents movement of the actuator 40 relative to the bucket that could cause the pin 64 to dislodge from the forks 57 as the bucket assembly 10' is used for work. As will be described below, when the selectively extendable member 58 is retracted, the attachment member 200 is uncoupled from the locking pin portion 210 and the bucket 34 can be quickly and conveniently removed and replaced with another tool. This allows for quick and easy attachment of a different size or style bucket or other tool to the actuator as the job demands.

In the first alternative embodiment of FIG. 7, the interiorly threaded intermediate portion 118 of the shaft aperture 116 extends over a larger longitudinal length of the shaft aperture 116 than in the first-described embodiment of FIG. 1, and has a diameter substantially the same as the diameter of the smooth-walled portion 120 of the shaft aperture. In this first alternative embodiment, the selectively extendable member 58 has a threaded member portion 212 coaxially and threadably received in the correspondingly threaded aperture portion 118. The threaded member portion 212 terminates in a slightly enlarged smooth-walled member portion 214 of the extendable member 58 which is slidably disposed in the smooth-walled portion 120 of the shaft aperture 116. The locking pin portion 210 is attached to the smooth-walled member portion 214 at an end toward the second body end 48. The locking pin portion 210 carries a seal 216 in a circumferential groove. In the illustrated embodiment, the threaded member portion 212, the smooth-walled member portion 214, and the locking pin portion 210, are formed as an integral unit.

A sleeve 218 is positioned in the shaft aperture 116 at its opening **116*b*. The sleeve 218 has an annular flange portion 220 positioned outward of the body 42 at the second body end 46. The sleeve 218 is held in position within the shaft aperture 116 by an annular clamp 222 which is attached to the shaft nut 54 using a plurality of threaded fasteners 224. The sleeve 218 has a smooth-walled central aperture 226 within which the locking pin portion 210 is slidably disposed. The seal 216 is provided to keep contaminates out. A seal 228 is provided between the sleeve 218 and the body sidewall 44** to keep contaminants out.

An outward end face 230 of the sleeve 218 is designed to contact the block 204 in which the receiver aperture 202 is formed to eliminate slack when the forks 57 are coupled to the first bucket clevis 36 and the locking pin portion 210 is fully extended. To achieve a snug fit, the position of the block 204 relative to the end face 230 of the sleeve 218 is adjustable using a plurality of shims 232 positioned between the block 204 and the head portion 206 of the bucket attachment member 200. The shims 232 are held in place by the fasteners 208.

Figure 8:
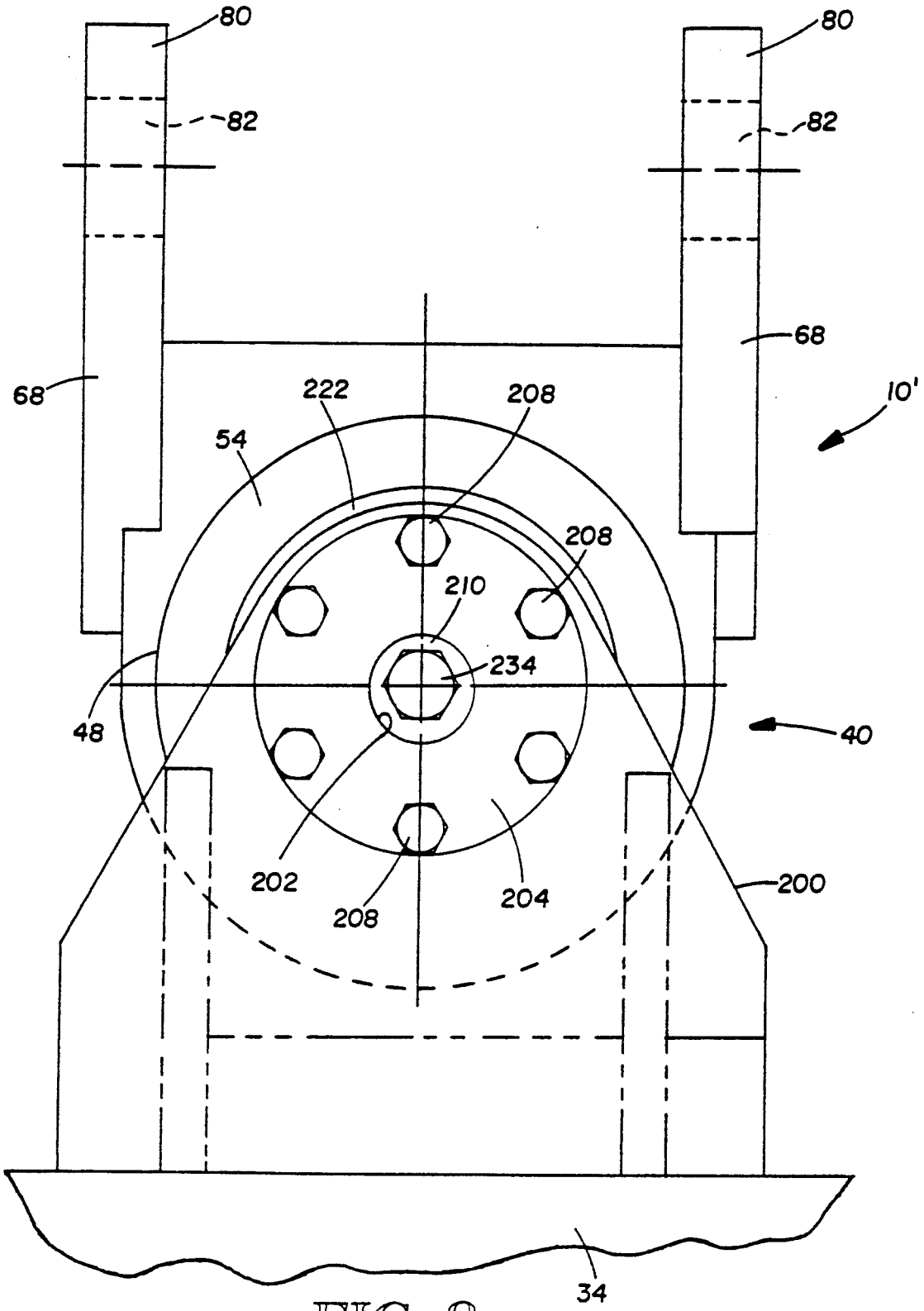
FIG. 8 is a fragmentary, rear elevational view of the bucket assembly of FIG. 7.
Figures 9A, 9B, 9C, 9D:
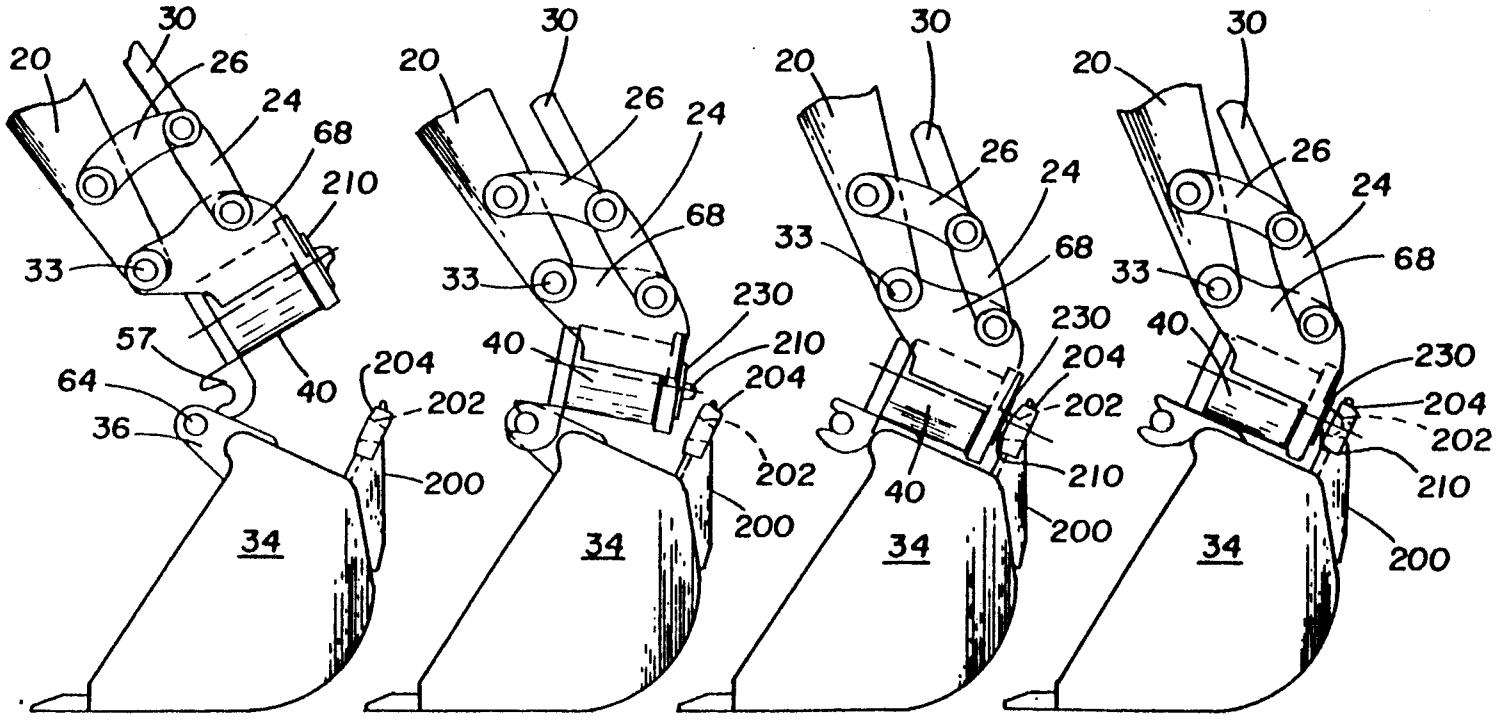
FIGS. 9A–E are reduced scale drawings of the bucket assembly of FIG. 7 showing a sequence illustrating attachment of the bucket to the bucket actuator.

The axial movement and position of the extendable member 58 is achieved by rotation of the threaded member portion 212 thereof to move the extendable member and hence the locking pin portion 210 formed integrally therewith between the release position shown in FIG. 7 and the locking position shown in FIG. 9D. In the release position, the locking pin portion 210 is substantially fully retracted within the shaft aperture 116 and disengaged from the receiver aperture 202 of the bucket attachment member 200. In the locking position, the locking pin portion 210 is projecting out of the shaft aperture 116 sufficiently to engage the receiver aperture 202 of the bucket attachment member 200. The threaded member portion 212 is rotated to selectively retract or extend the extendable member 58 by use of a tool (not shown) which is sized to operatively engage an hexagonal recess 234 formed in the outward end of the locking pin portion 210, as best illustrated in FIG. 8. The receiver aperture 202 extends fully through the block 204 of the bucket attachment member 200 to allow the tool to access the hexagonal recess 234 with the bucket 34 attached to the actuator 40.

Manual rotation of the extendable member 58 moves it and the locking pin portion 210 between the retracted and locking positions. The threaded member portion 212 has sufficient axial length to accommodate the axial travel of the extendable member 58 required to fully move the locking pin portion 210 between its fully retracted position and its fully seated positions within the bucket receiver aperture 202. A spring 236 is positioned within the shaft aperture 116 and extends into a cavity 238 of the threaded member portion 212 which opens toward the first body end 46. One end of the spring 236 abuts against a closed end wall 240 of the shaft aperture 116 toward the first body end 46 and the other end abuts against an end face 242 of the smooth-walled member portion 214 located interior of the cavity 238 to bias the extendable member 58 relative to the shaft 50 in the direction toward the second body end 48. As a result, unintended rotation of the extendable member 58 within the shaft aperture 116 is inhibited during operation of the bucket assembly 10'. A plug 244 is provided in the closed end wall 240 to provide access to the shaft aperture 116.

The sequence of operations used to attach the bucket 34 to the actuator 40 of FIG. 7 (and also of the actuator of FIG. 11 which will be described below) is illustrated in FIGS. 9A–9E. First, as shown in FIG. 9A, the second arm 20 is moved so that the forks 57 are in position to be coupled to the first bucket clevis 36. As shown in FIG. 9B, the hydraulic cylinder 30 is then extended to rotate the actuator 40 about attachment pin 33 so that the forks 57 grasp the pin 64 of the first bucket clevis. With the forks 57 grasping the pin 64 and the locking pin portion 210 fully retracted (i.e., the extendable member 58 is moved into the release position), the hydraulic cylinder 30 is further extended to rotate the actuator 40 into a position with the outward end face 230 of the sleeve 218 in juxtaposition with the block 204 of the bucket attachment member 200. The locking pin portion 210 is thereby placed in coaxial alignment with the receiver aperture 202 as shown in FIG. 9C. The extendable member 58 is then moved into the locking position with the locking pin portion 210 fully in the receiver aperture 202, as shown in FIG. 9D.

Figure 10:
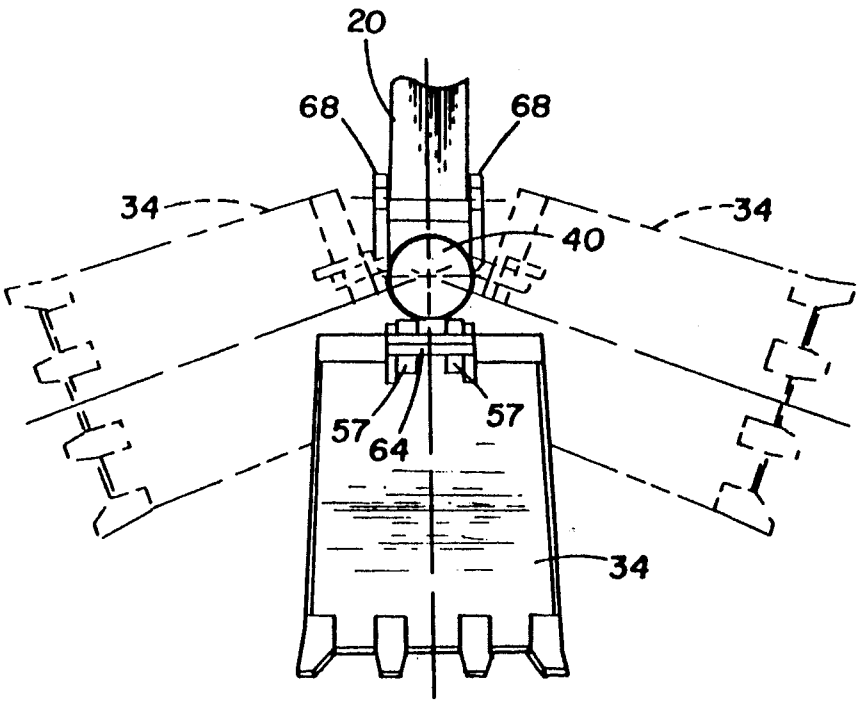
FIG. 10 is a reduced scale drawing of the bucket assembly of FIG. 7 showing the extent of left and right lateral tilting of the bucket provided by the bucket actuator.
Figure 9E:
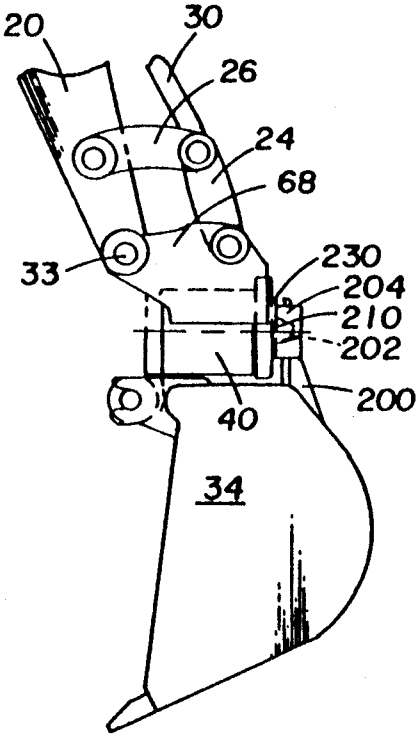

The bucket 34 can now be lifted by moving the second arm 20 and the bucket rotated through the forward rotating plane by operation of the hydraulic cylinder 30, as shown in FIG. 9E. In this manner, the operator does not need to manually lift or otherwise move the bucket 34, which is desirable when using larger buckets and tools. The just-described sequence of operations can be performed in reverse to disconnect the bucket 34 from the actuator 40. The extend of left and right lateral tilting of the bucket 34 using the actuator 40 is illustrated in FIG. 10.

Figure 11:
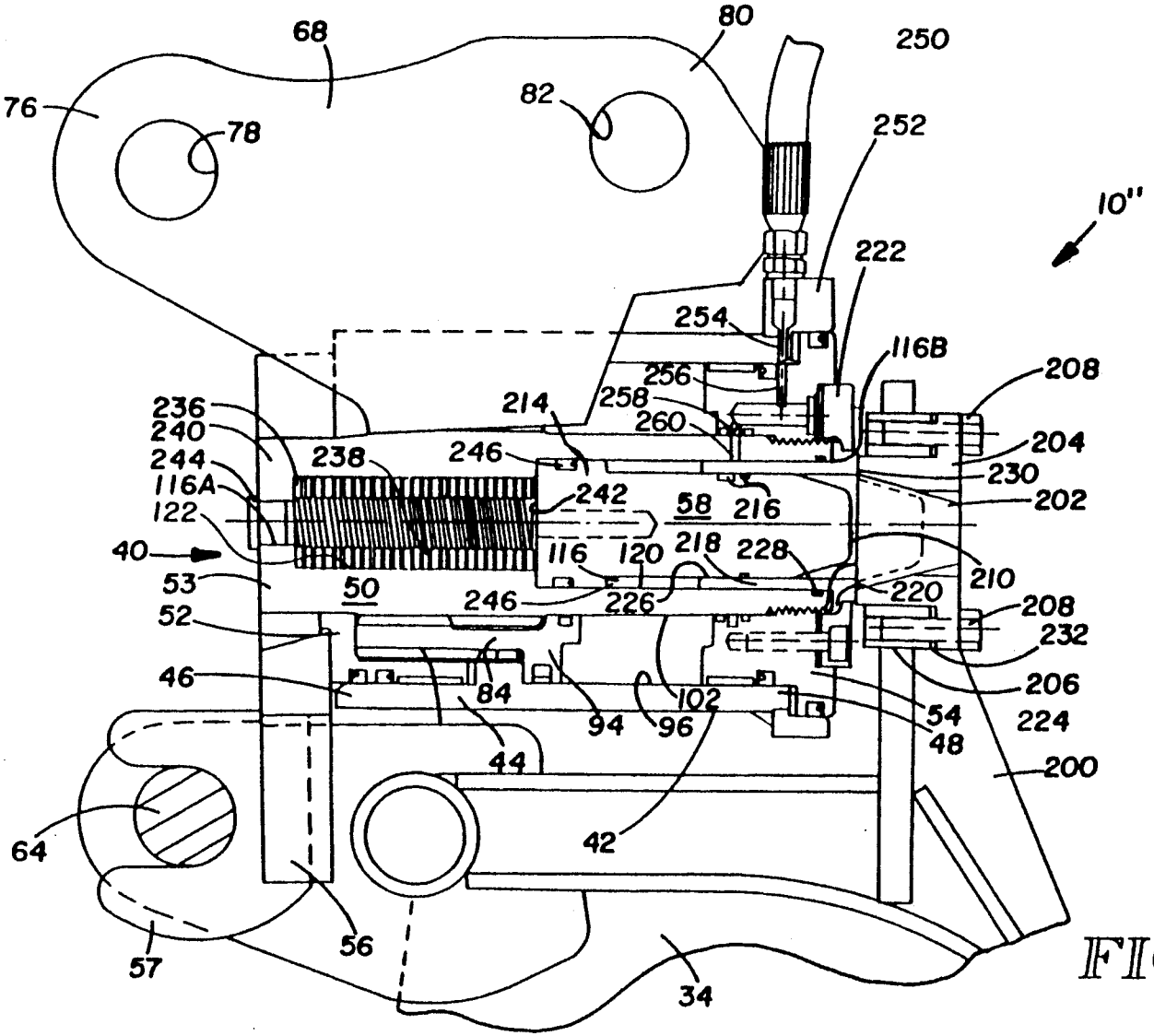
FIG. 11 is a fragmentary, left side elevational view of a second alternative embodiment of the bucket assembly of FIG. 1 showing a second alternative bucket actuator in cross-section.

A second alternative embodiment of the bucket assembly 10'' is shown in FIG. 11. In this embodiment, the extendable member 58 is movable without the need to use a manual tool. The threaded portion 212 of the first alternative embodiment of FIG. 7 is eliminated and the smooth-walled member portion 214 carries a seal 246 in a circumferential groove to provide a fluid-tight seal between the smooth-walled member portion and the smooth-walled portion 120 of the shaft aperture 116. The smooth-walled member portion 214 serves as a piston and defines a fluid-tight compartment 248 comprising the portion of the shaft aperture 116 to the side thereof toward the second body end 48. Hydraulic fluid under pressure is selectively applied to the compartment 248 and hence the side of the smooth-walled member portion 214 toward the second body end 48, by a hydraulic line 250 connected to a mounting block 252 attached to the body sidewall 44. The hydraulic line 250 is connected to a manual control (not shown) mounted within the vehicle 12 or at any other location convenient for the operator.

Pressurized fluid is communicated to the smooth-walled member portion 214 for fluid engagement therewith through a port 254 in the body sidewall 44, ports 256 and 258 in the shaft nut 54, and a port 260 in the smooth-walled portion 120 of the shaft 50 which leads to the compartment 248. The application of pressurized fluid to the compartment 248, to the side of the smooth-walled member portion 214 toward the second body end 48, drives the extendable member 58 toward the first body end 46 to cause retraction of the locking pin portion 210 fully within the shaft aperture 116 and thereby withdraws the locking pin portion from the receiver aperture 202. As long as pressurized fluid is so applied, the extendable member 58 does not return and the locking pin portion 210 stays in the retracted position (i.e., the release position).

When relieved of the pressurized fluid by the operator using the manual control, the spring 236 moves the extendable member 58 toward the second body end 48 and the locking pin portion 210 into the fully extended position shown by broken line in FIG. 11 (i.e., the locking position with the locking pin portion seated in the receiver aperture 202). Not only does this arrangement avoid the operator needing to use a manual tool to connect and disconnect the bucket 34, but it also allows the process of connecting and disconnecting the bucket to be accomplished with the operator remaining in the vehicle 12. From the vehicle 12, the operator can operate the hydraulic controls to position the second arm 20 and the hydraulic cylinder 30 as required to connect and disconnect the bucket or other tools without manually lifting or otherwise moving them as described above for FIGS. 9A–9G. This makes the connection and disconnection process extremely quick and easy. The spring 236 in this second alternative embodiment has sufficient force and length to evacuate the hydraulic fluid in the shaft aperture 116 back out through the ports 254, 256, 258 and 260 as needed and return the extendable member 58 to the locking position when the manual control relieves the pressurized fluid. Also, the seals 216 and 228 are sufficient to not only keep out contaminants but also prevent fluid leakage from the shaft aperture 116.

It is to be understood that while the actuator 40 of the second alternative embodiment has been described as using the spring 236 to return the extendable member to the locking position, the smooth-walled member portion 214 can also be operated as a two-way piston by the selective application of pressurized fluid to the side thereof toward the first body end 46. In this case, however, it is still desirable to use a spring or a latching arrangement to keep the extendable member 58 in the locking position in case of fluid pressure failure while working to prevent the bucket 34 from unintentionally disconnecting from the actuator 40.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A fluid-powered laterally tiltable bucket assembly, usable with a vehicle having an arm and a rotation link associated therewith for rotation of the bucket assembly in a first plane defined by movement of the rotation link relative to the arm, each of the arm and rotation link having an attachment member located toward a free end thereof, the bucket assembly comprising:

a bucket having a working edge extending laterally, generally transverse to the first plane, a first bucket attachment member and a second bucket attachment member located away from said first bucket attachment member, said first and second bucket attachment members being arranged in general parallel alignment with the first plane;

a body having a longitudinal axis and first and second ends;

an attachment bracket rigidly attached to said body and having an external first bracket attachment member located generally along said body axis for pivotal attachment to the vehicle arm by the arm attachment member and an external second bracket attachment member located generally along said body axis away from said first bracket attachment member for pivotal attachment to the rotation link by the rotation link attachment member, said first and second bracket attachment members being selectively detachable from the arm and rotation link attachment members, wherein with said first and second bracket attachment members attached to the arm and rotation link attachment members, movement of the rotation link causes said body to rotate about the vehicle arm with movement of said longitudinal axis of said body in generally parallel alignment with the first plane, and wherein the bucket assembly is selectively detachable from the vehicle arm and rotation link;

an output shaft rotatably disposed within said body in general coaxial arrangement with said body and having a first shaft end portion extending at least to said first body end and a second shaft end portion extending toward said second body end, said first shaft end portion having a first shaft attachment member which is releasably coupled to said first bucket attachment member, said shaft having a longitudinally extending aperture therein with an open end toward said second body end;

a second shaft attachment member longitudinally extendable relative to said second shaft end portion and releasably coupled to said second bucket attachment member, said second shaft attachment member being selectively longitudinally movable between a locking position with said first and second shaft attachment members positioned to attach sad bucket to said shaft for rotation with said shaft through a second plane extending laterally, generally transverse to the first plane and a release position with said first and second shaft attachment members positioned to allow disconnection of said bucket from said shaft;

an actuator operatively engaging said second shaft attachment member for selectively moving said second shaft attachment member between said locking and release positions; and a linear-to-rotary torque transmitting member mounted for longitudinal movement within said body in response to selective application of pressurized fluid thereto, said torque-transmitting member engaging said body and said shaft to translate longitudinal movement of said shaft relative to said body, whereby said bucket is rotatable in the first plane and laterally tiltable in the second plane.

2. The bucket assembly of claim 1 wherein said shaft has a longitudinally extending aperture therein with an open end toward said second body end, and said second shaft attachment member is at least partially disposed within said shaft aperture, and wherein said actuator selectively moves said second shaft attachment member longitudinally within said shaft aperture sufficiently to move said second shaft attachment member between said locking and release positions.

3. The bucket assembly of claim 2, wherein said second shaft attachment member moves into a retracted position at least partially within said shaft aperture to disengage from said second bucket attachment member when moved to said release position, and into a projecting position projecting at least partially out of said shaft aperture open end to engage said second bucket attachment member when moved to said locking position.

4. The bucket assembly of claim 3, wherein said second bucket attachment member includes a receiver aperture, and said second shaft attachment member includes a locking pin sized to fit within said receiver aperture when moved to said locking position.

5. The bucket assembly of claim 2, wherein said shaft aperture includes an interiorly threaded aperture portion and said member actuator is a threaded member having a threaded member portion threadably received in said shaft threaded aperture portion, said second shaft attachment member being in engagement with said threaded member for longitudinal movement therewith, said threaded member being selectively rotatable relative to said shaft to rotate said threaded member portion within said shaft threaded aperture portion and thereby selectively move said threaded member and said second shaft attachment member longitudinally relative to said shaft, said threaded member portion having a sufficient length when rotated to longitudinally move said second shaft attachment member between said locking and release positions.

6. The bucket assembly of claim 5, wherein said threaded member is attached to said second shaft attachment member to transmit rotational forces therebetween, and said second shaft attachment member has a terminal end toward said shaft aperture open end engageable by a tool for selectively rotating said threaded member to move said second shaft attachment member between said locking and release positions.

7. The bucket assembly of claim 5 wherein said actuator includes a spring positioned in said shaft aperture and engaging said threaded member to apply a longitudinal force between said shaft and said threaded member to inhibit unintended rotation of said threaded member within said shaft threaded aperture portion during operation of the bucked assembly.

8. The bucket assembly of claim 5, wherein said threaded member and said second shaft attachment member are formed as an integral unit.

9. The bucket assembly of claim 2 wherein said actuator includes a piston positioned within said shaft aperture and in engagement with said second shaft attachment member for longitudinal movement of said second shaft attachment member with said piston into at least one of said locking or release positions in response to the selective application of pressurized fluid to said piston.

10. The bucket assembly of claim 9 wherein said actuator includes a spring positioned within said shaft aperture and engaging said piston to apply a longitudinal force between said shaft and said piston to longitudinally move said second shaft attachment member into the other of said locking or release positions.

11. The bucket assembly of claim 10, wherein, upon the application of pressurized fluid to said piston, said piston moves said second shaft attachment member to said release position with said second shaft attachment member retracted sufficiently within said shaft aperture to disengage from said second bucket attachment member and upon the release of pressurized fluid to said piston, said spring moves said second shaft attachment member to said locking position with said second shaft attachment member extending out of said shaft aperture sufficiently to engage said second bucket attachment member.

12. The bucket assembly of claim 9 wherein said piston and said second shaft attachment member are formed as an integral unit.

13. A fluid-powered tool actuator, usable with a vehicle having an arm and a rotation link associated therewith for rotation of a tool in a first plane defined by movement of the rotation link relative to the arm, each of the arm and rotation link having an attachment member located toward a free end thereof, and usable with a tool having a first tool attachment member and a second tool attachment member located away from the first tool attachment member, the first and second tool attachment members being arranged in general parallel alignment with the first plane, the tool actuator comprising:

a body having a longitudinal axis and first and second ends;

an attachment bracket rigidly attached to said body and having an external first bracket attachment member located generally along said body axis for pivotal attachment to the vehicle arm by the arm attachment member and an external second bracket attachment member located generally along said body axis away from said first bracket attachment member for pivotal attachment to the rotation link by the rotation link attachment member, said first and second bracket attachment members being selectively detachable from the arm and rotation link attachment members, wherein the said first and second bracket attachment members attached to the arm and rotation link attachment members, movement of the rotation link causes said body to rotate about the vehicle arm with movement of said longitudinal axis of said body in generally parallel alignment with the first plane, and wherein the tool actuator is selectively detachable from the vehicle arm and rotation link;

an output shaft rotatably disposed within said body in general coaxial arrangement with said body and having a first shaft end portion extending at least to said first body end and a second shaft end portion extending toward said second body end, said first shaft end portion having a first shaft attachment member which is releasably attachable to the first tool attachment member, said shaft having a longitudinally extending aperture therein with an open end toward said second body end;

a second shaft attachment member longitudinally extendable relative to said second shaft end portion and releasably attachable to the second tool attachment member, said second shaft attachment member being selectively longitudinally movable between a locking position with said first and second shaft attachment members positioned to attach the tool to said shaft for rotation with said shaft through a second plane extending laterally, generally transverse to the first plane and a release position with said first and second shaft attachment member positioned to allow disconnection of the tool from said shaft;

an actuator operatively engaging said second shaft attachment member for selectively moving said second shaft attachment member between said locking and release positions; and a linear-to-rotary torque transmitting member mounted for longitudinal movement within said body in response to selective application of pressurized fluid thereon, aid torque-transmitting member engaging said body and said shaft to translate longitudinal movement of said torque-transmitting member into rotational movement of said shaft relative to said body, whereby the tool is rotatable in the first plane and laterally tiltable in the second plane.

14. The tool actuator of claim 13 wherein said shaft has a longitudinally extending aperture therein with an open end toward said second body end, and said second shaft attachment member is at least partially disposed within said shaft aperture, and wherein said actuator selectively moves said second shaft attachment member longitudinally within said shaft aperture sufficiently to move said second shaft attachment member between said locking and release positions.

15. The tool actuator of claim 14, wherein said second shaft attachment member moves into a retracted position at least partially within said shaft aperture to disengage from the second tool attachment member when moved to said release position, and into a projecting position projecting at least partially out of said shaft aperture open end to engage the second tool actuator member when moved to said locking position.

16. The tool actuator of claim 15, wherein the second tool attachment member includes a receiver aperture, and said second shaft attachment member includes a locking pin sized to fit within said receiver aperture when moved to said locking position.

17. The tool actuator of claim 14, wherein said shaft aperture includes an interiorly threaded aperture portion, and said member actuator is a threaded member having a threaded member portion threadably received in said shaft threaded aperture portion, said second shaft attachment member being in engagement with said threaded member for longitudinal movement therewith, said threaded member being selectively rotatable relative to said shaft to rotate said threaded member portion within said shaft threaded aperture portion and thereby selectively move said threaded member and said second shaft attachment member longitudinally relative to said shaft, said threaded member portion having a sufficient length when rotated to longitudinally move said second shaft attachment member between said locking and release positions.

18. The tool actuator of claim 17, wherein said threaded member is attached to said second shaft attachment member to transmit rotational forces therebetween, and said second shaft attachment member has a terminal end toward said shaft aperture open end engageable by a tool for selectively rotating said threaded member to move said second shaft attachment member between said locking and release positions.

19. The tool actuator of claim 17 wherein said actuator includes a spring positioned in said shaft aperture and engaging said threaded member to apply a longitudinal force between said shaft and said threaded member to inhibit unintended rotation of said threaded member within said shaft threaded aperture portion during operation of the tool actuator.

20. The tool actuator of claim 17, wherein said threaded member and said second shaft attachment member are formed as an integral unit.

21. The tool actuator of claim 14 wherein said actuator includes a piston positioned within said shaft aperture and in engagement with said second shaft attachment member for longitudinal movement of said second shaft attachment member with said piston into at least one of said locking or release positions in response to the selective application of pressurized fluid to said piston.

22. The tool actuator of claim 21 wherein said actuator includes a spring positioned within said shaft aperture and engaging said piston to apply a longitudinal force between said shaft and said piston to longitudinally move said second shaft attachment member into the other of said locking or release positions.

23. The tool actuator of claim 22, wherein, upon the application of pressurized fluid to said piston, said piston moves said second shaft attachment member to said release position with said second shaft attachment member retracted sufficiently within said shaft aperture to disengage from said second tool attachment member, and upon the release of pressurized fluid to said piston, said spring moves said second shaft attachment member to said locking position with said second shaft attachment member extending out of said shaft aperture sufficiently to engage said second tool attachment member retracted sufficiently within said aperture to disengage from said tool attachment member.

24. The tool actuator of claim 21, wherein said piston and said second shaft attachment member are formed as an integral unit.

* * * * *

UNITED STATES PATENT AND TRADEMARK OFFICE

CERTIFICATE OF CORRECTION

PATENT NO. : 5,242,258

DATED : September 7, 1993

INVENTOR(S) : Paul P. Weyer

It is certified that error appears in the above-indentified patent and that said Letters Patent is hereby corrected as shown below:

In column 18, claim 7, line 5, please delete "bucked" and substitute therefor --bucket--.

In column 18, claim 13, line 63, please delete "the" and substitute therefor --with--.

In column 19, claim 13, line 34, please delete "aid" and substitute therefor --said--.

Signed and Sealed this

Nineteenth Day of April, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,242,258

DATED : September 7, 1993

INVENTOR(S) : Paul P. Weyer

It is certified that error appears in the above-identified patent and that said Letters Patent is hereby corrected as shown below:

In column 17, claim 1, line 18, between "movement of" and "said shaft" please insert --said torque-transmitting member into rotational movement of--.

In column 20, claim 23, lines 59 and 60, please delete "retracted sufficiently within said aperture to disengage from said tool attachment member".

UNITED STATES PATENT AND TRADEMARK OFFICE

CERTIFICATE OF CORRECTION

PATENT NO. : 5,242,258

DATED : September 7, 1993

INVENTOR(S) : Paul P. Weyer

It is certified that error appears in the above-identified patent and that said Letters Patent is hereby corrected as shown below:

In column 18, claim 7, line 5, please delete "bucked" and substitute therefor --bucket--.

In column 18, claim 13, line 63, please delete "the" and substitute therefor --with--.

In column 19, claim 13, line 34, please delete "aid" and substitute therefor --said--.

Signed and Sealed this

Fourteenth Day of June, 1994

Bruce Lehman

*Attest:*

BRUCE LEHMAN

*Attesting Officer*

*Commissioner of Patents and Trademarks*